US006120202A

United States Patent [19]

Donsky

[11] Patent Number: 6,120,202

[45] Date of Patent: Sep. 19, 2000

[54] NAIL POLISH APPLICATOR BOTTLE

[76] Inventor: Robin Donsky, 6130 Prestoncrest La., Dallas, Tex. 75230

[21] Appl. No.: 09/336,913

[22] Filed: Jun. 21, 1999

[51] Int. Cl.[7] ..... B43K 27/04

[52] U.S. Cl. ..... 401/35; 401/34; 401/17

[58] Field of Search ..... 401/35, 34, 16, 401/17, 22, 23, 24

[56] References Cited

U.S. PATENT DOCUMENTS

| | | | |
|---|---|---|---|
| 158,066 | 12/1874 | Hall . | |
| 1,767,118 | 6/1930 | Bugg | 401/35 |
| 2,691,184 | 10/1954 | Miller et al. . | |
| 4,600,328 | 7/1986 | Clements . | |
| 4,640,637 | 2/1987 | Winthrop . | |
| 4,927,282 | 5/1990 | Morane et al. . | |
| 4,955,745 | 9/1990 | Vauquelin . | |
| 5,035,525 | 7/1991 | Konose . | |
| 5,052,839 | 10/1991 | Pettengill . | |
| 5,306,092 | 4/1994 | Jeng | 401/17 |
| 5,620,270 | 4/1997 | Gueret . | |
| 5,810,497 | 9/1998 | Bachmann et al. . | |
| 5,826,741 | 10/1998 | Dumler et al. . | |

*Primary Examiner*—David J. Walczak
*Attorney, Agent, or Firm*—Rick Matos; Innovar, L.L.C.

[57] ABSTRACT

A method of simultaneously applying two or more different nail polishes to a nail and a nail polish applicator system therefor. The applicator system is a multi-chambered container or bottle having in each chamber a reservoir of a different nail polish. The bottle is covered with a mating cap that has multiple brushes. The number of brushes equals the number of chambers in the container. The nail polish applicator system can be used to make linear or circular striped designs on nails.

20 Claims, 4 Drawing Sheets

NAIL POLISH APPLICATOR BOTTLE

FIELD OF THE INVENTION

The present invention is directed to a method of applying nail polish and an applicator bottle therefore.

BACKGROUND OF THE INVENTION

Applicator bottles used for applying nail polish to finger and/or toe nails have long been known. These bottles include a single nail polish-filled internal chamber having a single cap engaged with a single applicator, which applicator is placed in the chamber. The nail polish reservoir is always of a single color, so that only a single color or type of nail polish can be applied to a finger or toe nail at any given time. Examples of a wide range of nail polish applicators, bottles, and brushes are disclosed in the following U.S. Pat. No. 5,826,741 to Dumler et al., U.S. Pat. No. 5,810,497 to Bachmann et al., U.S. Pat. No. D387,909 to Mattson, U.S. Pat. No. 5,655,554 to Goldberg, U.S. Pat. No. 5,645,090 to Juhl et al., U.S. Pat. No. 5,638,837 to Juhl et al., U.S. Pat. No. D363,375 to Arntsen, U.S. Pat. No. D353,101 to Desgrippes, U.S. Pat. No. D345,918 to Chevassus, U.S. Pat. No. D341,255 to Leone, U.S. Pat. No. D333,573 to Kamen, U.S. Pat. No. D331,697 to Desgrippes, U.S. Pat. No. D325,523 to Restrepo, U.S. Pat. No. 5,035,525 to Konose, U.S. Pat. No. 4,998,315 to Pessis, U.S. Pat. No. D311,258 to Jankewitz, U.S. Pat. No. 4,955,745 to Vauquelin, U.S. Pat. No. 4,944,318 to Gaylord, Jr. et al., U.S. Pat. No. D308,635 to Dinunccio, U.S. Pat. No. 4,927,282 to Morane et al., U.S. Pat. No. 4,917,520 to Reid et al., U.S. Pat. No. D291,374 to Korper, U.S. Pat. No. D289,088 to Jankewitz, U.S. Pat. No. 4,640,637 to Winthrop, U.S. Pat. No. 4,635,657 to Stanford, U.S. Pat. No. D285,011 to Jankewitz, U.S. Pat. No. 4,454,622 to Poppendieck, U.S. Pat. No. 4,359,060 to Walker, and U.S. Pat. No. 4,194,617 to Bandell.

These days, the designs created on finger and toe nails by manicurists are quite intricate. Many of these designs employ two or more differently colored nail polishes. Also, these designs typically include multi-colored stripes. The methods of and applicators for applying the nail polish to a nail, however, have not evolved to keep pace with the advancements in design. Creating these intricate designs is still time consuming and therefore unnecessarily expensive.

U.S. Pat. No. 5,052,839 to Pettengill discloses a dual chambered mascara applicator comprising a dual brush assembly that snaps together with a dual chambered mascara reservoir. U.S. Pat. No. 4,600,328 to Elements discloses a dual chambered mascara applicator very similar to that described in the Pettengill patent except that the shape of the bristles on the dual brush of this applicator have been designed to have a particular construction. In each of these systems, the mascara is of the same color in each chamber, and the brushes are of a construction which is optimized for applying mascara but which is totally unsuitable for applying nail polish.

Accordingly, a need remains for a nail polish applicator system which will facilitate the creation of intricate, and in particular striped, designs. The art neither discloses nor suggests a nail polish applicator system as claimed herein.

SUMMARY OF THE INVENTION

The present invention provides a nail polish applicator which is adapted to simultaneously apply two or more different types of nail polishes to a nail. The applicator is particularly useful for forming striped and/or circular designs on the surface of a nail.

In one aspect, the invention provides a nail polish applicator comprising:

a container having at least first and second open chambers, the first chamber containing a first nail polish and the second chamber containing a different second nail polish;

at least one cap adapted to seal and cover the openings of the first and second chambers; and at least first and second applicators, the first applicator being adapted to apply the first nail polish to a nail and the second applicator being adapted to simultaneously apply the second nail polish to the same nail.

The first and second applicators generally comprise an extended member and applicator means, which can be a foam, sponge or bristle brush. A major portion of the bristles of the bristle brush are preferably aligned with the axis along which the extended member extends from the cap to the container. The cap can be either fixedly, removably, slidably, or rotatably engaged with the first and second applicators, and the cap can either snap onto or be threaded onto the container. The container can have one common opening shared by the openings of the first and second chambers, or it can have two or more openings corresponding to the openings of the chambers. The container can have at least two to four open chambers. The width, length, shape, spacing, and flexibility of the applicators can be varied as desired to provide specific design features. The applicator means can independently have at least one of the following: different shapes, variable spacing, different widths, different lengths, and different thicknesses. The container can comprise two or more individual containers that are placed side by side and which are held side by side by way of an attachment means.

In another aspect, the present invention provides a method of simultaneously applying two different nail polishes to a nail comprising the steps of:

(a) providing an applicator comprising at least first applicator means having thereon a first nail polish and second applicator means having thereon a different second nail polish, wherein the first and second applicator means are disposed side by side; and (b) simultaneously applying the first and second nail polishes to the nail.

This method can further comprise one or more of the steps of:

(c) providing at least first and second open chambers, the first chamber containing the first nail polish and the second chamber containing the second nail polish; and (d) providing closing and retaining means for sealing the open first and second chambers and temporarily retaining the first and second applicator means, respectively, therein.

The first and second applicator means can be individual means which are held together by an attachment means or they can be integrally formed but divided to provide the first and second applicator means. One or more caps or other similar structure can be used to close the open chambers and retain the first and second applicator means with the first and second chambers, respectively.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

Figure 1:
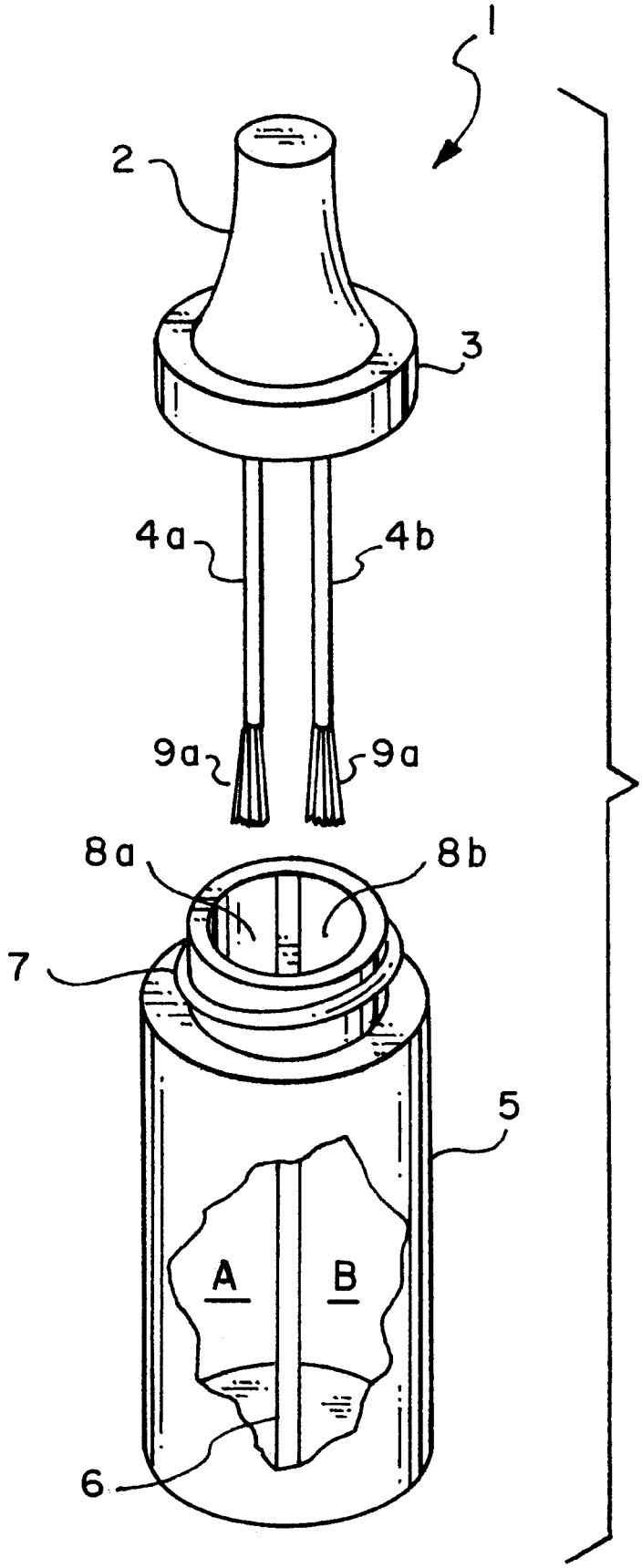
FIG. 1 is a perspective cut-away sectional view of a first embodiment of the nail polish applicator according to the invention.

The applicator according to the invention generally comprises at least two applicator brushes, at least one cap and a container having at least two chambers, each chamber containing nail polish. FIG. 1 depicts a nail polish applicator according to the invention (1) which comprises a cap (3) having a handle (2) and two applicator means (4*a*, 4*b*). The applicator means comprise respective applicator brushes (9*a*, 9*b*). The applicator system also comprises a container (5) which has dual chambers (A, B) that are separated by a divider (6). Each of the chambers (A, B) has a respective opening (8*a*, 8*b*) through which the applicator brushes pass. The chambers (A, B) contain respective nail polish reservoirs which are different. The cap (3) is held together with the bottle (5) by means of the threaded neck (7) on the bottle and a mating threaded recess (not shown) in the cap (3).

The spacing between the applicator means (4*a*, 4*b*) can be varied as desired to provide a particular effect when nail polish is applied to a nail. Preferably the distance between the brushes (9*a*, 9*b*) will be less than ½ inch, more preferably less than 1/4 inch and most preferably less than ⅛ inch. The length of the applicator means (4*a*, 4*b*) will be adjusted according to the depth of the chambers (A, B) of the bottle (5).

The applicator brushes (9*a*, 9*b*) can be made of a variety of materials and can include bristle brushes, foam pads, sponges, and combinations thereof. When bristle brushes are present, the bristles will preferably extend linearly along the direction of insertion of the brushes into the container (5). Substantially any type of porous material can be used in place of the bristle brushes to apply the nail enamel. The bristle brushes can vary in the firmness of the individual bristles provided the bristles retain some flexibility. In preferred embodiments, the bristles are soft, very flexible and provide a smooth finish to the applied nail polish. In another preferred embodiment, the bristles are somewhat less flexible and provide a roughened texture or appearance on the surface of the applied nail polish.

Figure 2:
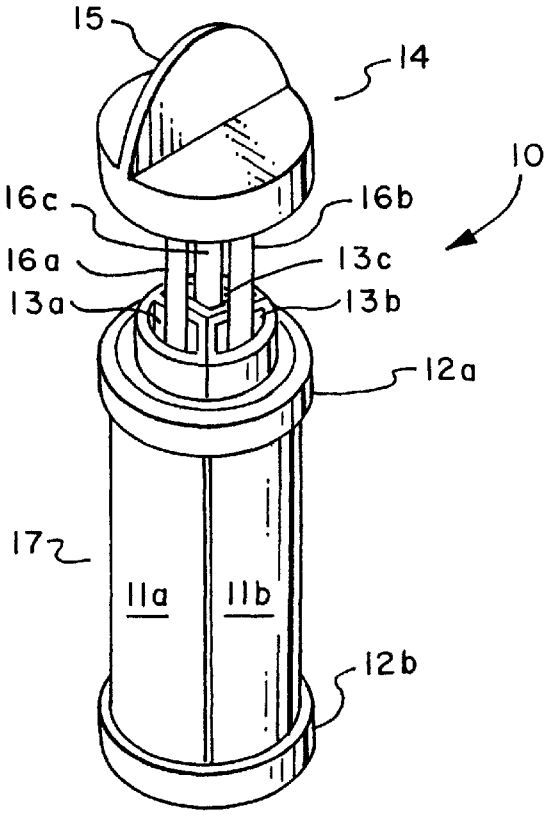
FIG. 2 is a perspective view of a second embodiment of the nail polish applicator according to the invention.

Although the bottle (5) depicted in FIG. 1 shows a unitary construction wherein the bottle has two chambers (A, B) separated by a divider (6), the multi-chambered container can comprise two or more individual containers that are held closely together by an attachment means. For example, FIG. 2 depicts a three-chambered container (17) comprising three individual chambers (11*a*, 11*b*, 11*c* (not shown)) which are held closely together by attachment means (12*a*, 12*b*). Each of the containers (11*a*–11*c*) has a respective opening (13*a*–13*c*). The openings are closely spaced to permit insertion of the applicator means (16*a*–16*c*) which are engaged with the cap (14). Thus, the applicator (10) is used to apply at least two and preferably three different nail polishes simultaneously to a nail. The attachment means (12*a*, 12*b*) can be any means known to those of ordinary skill in the art which is capable of retaining solid objects adjacent one another or together. For example, the attachment means can include tape, adhesive, brackets, band, strap, encasing film, wire, string, thread, and mating parts. Accordingly, the individual containers and chambers (11*a*–11*c*) can be provided individually and subsequently assembled into a three-chambered structure by way of attachment means (12*a*, 12*b*).

The cap (14), having a handle (15), is adapted to engage the neck of the container (17) by way of a pressure fit; however, the cap of an applicator can be secured to a respective container by any such means known to those of ordinary skill in the art for securing caps to bottles. For example, the cap can be threaded, snapped, or J-slotted onto the bottle.

Figure 3:
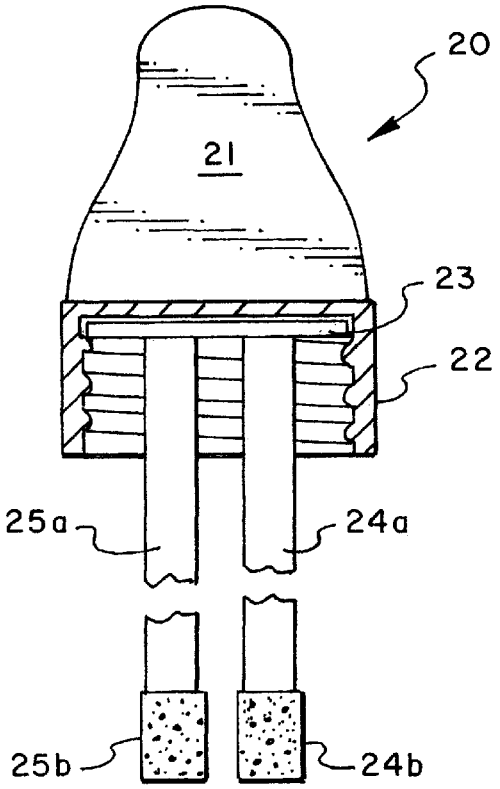
FIG. 3 is a side elevation partial sectional view of an alternate embodiment of a combination cap/applicator means according to the invention.

FIG. 3 depicts the cap (20) which comprises a handle portion (21) and a capping means (22) which is threadably engagable with the neck of a bottle such as that depicted in FIG. 1. The cap (20) includes an applicator assembly (23) which is slidably, removably, and rotatably engaged with the cap means (22). The top of the applicator assembly (23) is snapped into the cap means (22) such that the cap means (22) will be independently rotatable about the neck of a bottle while allowing the applicator assembly (23) to maintain a relative position with respect to that bottle, i.e., the applicator means need not rotate when the cap means (22) rotates.

The applicator assembly (23) includes the top portion which is integral with the extended members (24*a*, 25*a*) which have secured thereto applicator means, or foam pads, (24*b*, 25*b*), respectively. As mentioned above, the distance between the extended members (24*a*, 25*a*) can be varied as desired to either provide a particular design effect or to optimize mating with a bottle of a particular construction. The foam pads (24*b*, 25*b*) are made out of conventional foam material such as polyurethane foam or poly(vinyl alcohol) foam which materials are stable to nail polish. The porosity, flexibility, and density of the foams can be varied as desired. As well, the width of the foam pads, the distance between the foam pads, and the length and/or shape of the foam pads can be varied as desired. For example, if foam pad (24*b*) is substantially wider than the foam pad (25*b*), the applicator will create on a nail a thick stripe adjacent a thin stripe, each stripe having a different color. The applicator means of the invention can comprise foam, rubber, plastic, cotton, mohair, taffeta, urethane, neoprene, nylon fleece, terry cloth, tricot, felt and other smooth, porous, adsorbent, absorbent or fibrous materials used to apply liquids to surfaces. Other brushes or applicator means that can be used according to the invention are disclosed in U.S. Pat. No. 4,998,315, U.S. Pat. No. 4,917,520, U.S. Pat. No. 4,454,622, and U.S. Pat. No. 4,944,622, the entire disclosures of which are hereby incorporated by reference.

Figure 4:
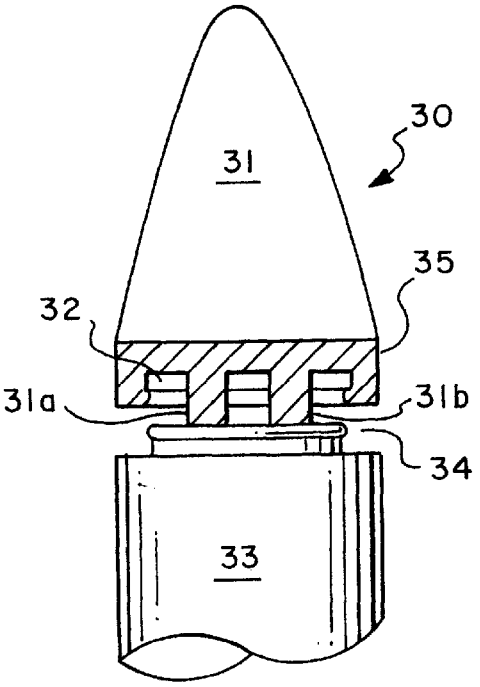
FIG. 4 is a side elevation partial sectional view of another alternate embodiment of a combination cap/applicator means according to the invention.

The cap of the invention can also be integral with the application means as depicted in FIG. 4. The cap (30) comprises a handle (31) which is integral with the applicator means (35) which comprises the extended members (31*a*, 31*b*) and their respective brushes (not shown). The cap forms a snap fit closure with the mouth (34) of a bottle (33).

While various specific constructions of the nail polish applicator have been disclosed herein, known dual chambered applicator systems can be modified according to the present invention to permit their use as nail polish applicators. For example, U.S. Pat. No. 5,052,839 to Pettengil, which is hereby incorporated in its entirety by reference, discloses a dual chambered mascara applicator. Many of the features included in the Pettengil mascara applicator can be used in the present nail polish applicator; however, the mascara reservoirs need to be changed to nail polish reservoirs. Also, the bristles on the brushes of the mascara applicator are entirely unacceptable for their use in applying nail polish. Therefore, a preferred embodiment of the invention includes those applicators wherein the bristles of the bristle brush extend longitudinally in the direction of insertion of the bristles into the container. Accordingly, the present invention provides a nail polish applicator comprising:

- a multi-chambered container having two or more side-by-side openings and each chamber comprising a different nail enamel reservoir; and
- a handle comprising two spaced apart, resiliently connected elements, each element connected to an applicator brush adapted to be placed in the openings to receive portions of respective nail polish reservoir on the brushes, the handle and brushes having means to sealingly engage the openings of the multi-chambered container to seal the openings, wherein when the brushes are withdrawn from the openings, the brushes can be brought closer together by applying pressure to the elements, and the bristles on the brushes extend longitudinally in the direction of insertion of the brushes into the multi-chambered container.

Another mascara applicator which can be modified according to the invention to serve as a nail polish applicator is disclosed in U.S. Pat. No. 4,600,328 to Elements which is hereby incorporated in its entirety by reference. Thus, another embodiment of the invention provides a container having two or more tubular cells adapted to house two or more portions of nail polish in mutual isolation, wherein the portions comprise different types of nail polish; and two brushes of a size and shape adapted to be repeatedly inserted into and removed from the cells with each of the brushes having a rod formed with bristles along a first end and a handle formed on the opposite end and with the bristles of the two brushes extending longitudinally along an axis defined by the rod.

Figure 5A:
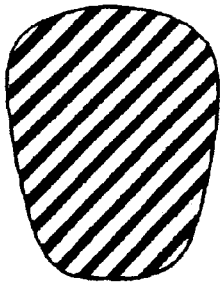
FIGS. 5*a*–5*j* are top plan views of various exemplary designs which can be created using the nail polish applicator of the invention.
Figure 5B:
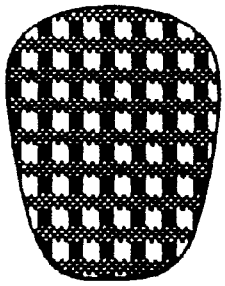
Figure 5C:
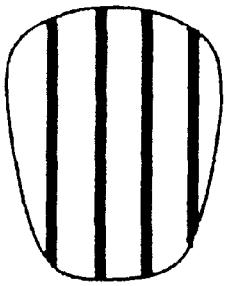
Figure 5D:
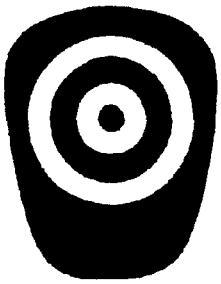
Figure 5E:
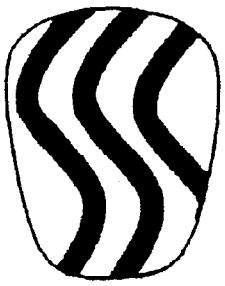
Figure 5F:
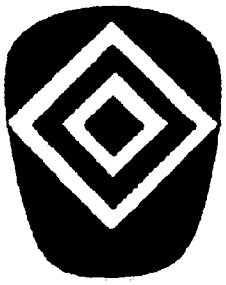
Figure 5G:
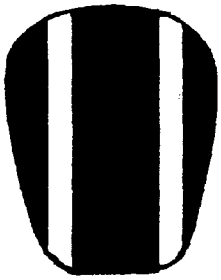
Figure 5H:
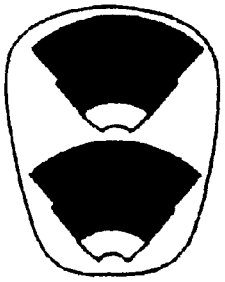
Figure 5I:
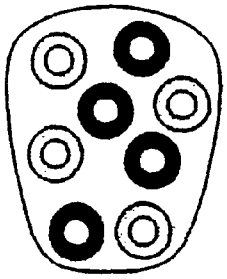
Figure 5J:
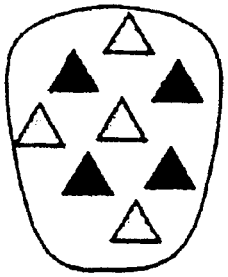

Since the shape, number and spacing of the applicator brushes can be varied as desired, a wide range of designs can be created using the present nail polish applicator. Exemplary embodiments are depicted in FIGS. 5*a*–5*h*. FIG. 5*a* was made using two narrow brushes of substantially the same width wherein the first brush had a dark color and a second brush had a light color nail polish. The design depicted in FIG. 5*b* was made by the same applicator of FIG. 5*a* except that the nail polishes were applied to form the underlying vertical stripes and subsequently blended with a blending tool to form the horizontal gray stripes. FIG. 5*c* depicts a design created with an applicator having a narrow foam pad and a wide foam pad where the narrow pad had a dark color nail polish and the wide pad had a light colored nail polish. FIG. 5*d* depicts a design created by painting the nail with a base nail polish and then painting the nail with the applicator of the invention having a first brush with a light colored nail polish and a second brush with a dark colored nail polish. FIG. 5*e* depicts a design created with the same applicator of FIG. 5*d* except that curved lines as opposed to circles were created. FIG. 5*f* depicts a design created with the same nail polish applicator used in FIG. 5*d* wherein overlapping squares rather than circles were created. FIG. 5*g* depicts a design created employing the color blending capability of the nail polish applicator according to the invention. The leftmost and rightmost stripes were created by gently pressing the applicator of FIG. 5*d* onto the surface of the nail so that little to no color blending occurred between the light and dark colored nail polishes. The gray stripes were created by pressing the applicator having the light and dark colors more firmly so that significant color overlap occurred and the dark and light colors were blended to form a third color which is a mixture of the first two colors. FIG. 5*h* depicts a design created using a three-brush applicator according to the invention wherein the brushes have a light, dark and gray color. FIG. 5*i* depicts a design created using the applicator means of FIG. 6*b*, wherein each circular pad bears a different colored nail polish. FIG. 5*j* depicts a design created using the applicator means of FIG. 6*a*, wherein each triangular pad bears a different colored nail polish.

Accordingly, the applicator system of the present invention can be used to create striped designs employing circular, linear, arcuate, curved, square, intersecting, parallel, overlapping, coextensive, and/or concentric lines.

Figure 6A:
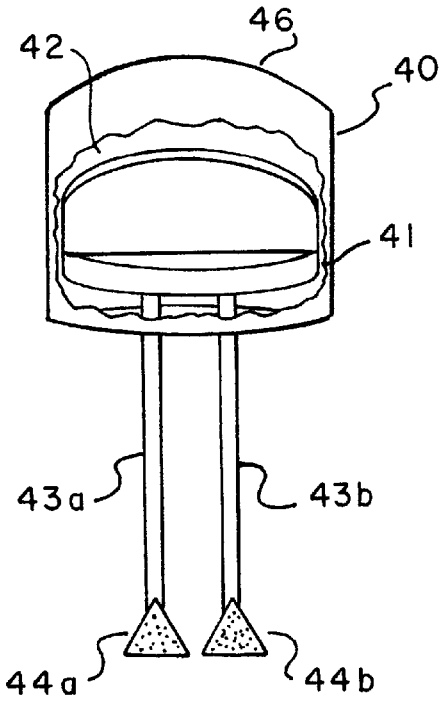
FIGS. 6*a*–6*b* are break-away perspective views of two alternate embodiments of the applicator means according to the invention.

FIG. 6*a* depicts an applicator assembly (40) comprising a base (41) having a handle (42) and two extended members (43*a*, 43*b*) attached thereto and/or integrally formed therewith. Each extended member has a respective triangular applicator means, or pad, (44*a*, 44*b*, respectively) attached thereto. The pads can be disposed in different orientations with respect to one another to create a particular design on a nail. The applicator assembly (40) is secured to a dual-chambered bottle by way of an overcap (46) which fits over the applicator assembly and is engaged with the bottle. The overcap also can also be used to sealingly engage the applicator assembly with the bottle. Otherwise, the applicator assembly can sealingly engage with the bottle and the overcap can independently provide additional hold of the applicator assembly to the bottle. The applicator assembly (40) is used to create the design of FIG. 5*j*.

Figure 6B:
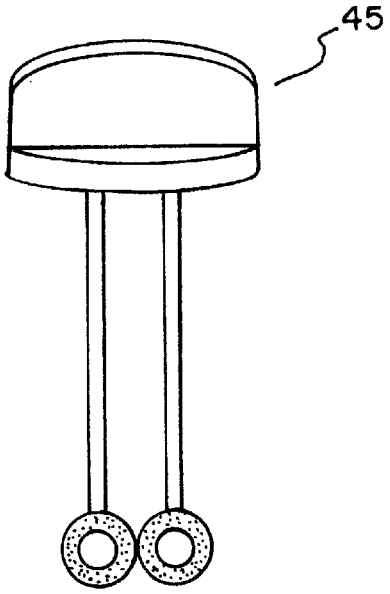

FIG. 6*b* depicts an applicator assembly (45) similar in construction to that of FIG. 6*b* except that the shape of the applicator means has been changed to a circle or donut. The applicator assembly of FIG. 6*b* is used to create the design depicted in FIG. 5*i*.

As used herein, the term "nail polish" is taken to mean any commercially available or known colored or uncolored material which is generally applied to a hand or toenail. Such materials are commercially available and widely sold as nail polishes or nail enamels. The nail polish can be colored, uncolored, iridescent, glow-in-the-dark, fluorescent, reflective, opaque, glossy, matted, or substantially any type of nail polish. Exemplary compositions of nail polishes include those which are slow drying, or fast drying, or which are disclosed in the following United States patents, the disclosures of which are hereby incorporated in their entirety by reference: U.S. Pat. No. 5,580,548, U.S. Pat. No. 5,213,598, U.S. Pat. No. 5,863,523, U.S. Pat. No. 5,811,084, U.S. Pat. No. 5,792,447, U.S. Pat. No. 5,766,332, U.S. Pat. No. 5,747,019, U.S. Pat. No. 5,747,018, U.S. Pat. No. 5,730,961, U.S. Pat. No. 5,723,108, U.S. Pat. No. 5,716,603, U.S. Pat. No. 5,688,494, U.S. Pat. No. 5,681,550, U.S. Pat. No. 5,693,447, U.S. Pat. No. 5,607,665, U.S. Pat. No. 5,549,930, U.S. Pat. No. 5,516,509, U.S. Pat. No. 5,484,586, U.S. Pat. No. 5,470,562, and U.S. Pat. No. 5,427,121.

Essentially any bottle, in particular those already used as nail polish applicator bottles, can be modified according to the invention to provide a suitable multi-chambered bottle having at least two different types of nail polishes which can be simultaneously applied to a nail with an applicator according to the invention. Exemplary bottles are disclosed in U.S. Pat. No. D308,635, U.S. Pat. No. D285,011, U.S. Pat. No. D289,088, U.S. Pat. No. D311,258, U.S. Pat. No. D387,909, U.S. Pat. No. D363,375, U.S. Pat. No. D353,101, U.S. Pat. No. D345,918, U.S. Pat. No. D341,255, U.S. Pat. No. D331,697, U.S. Pat. No. D325,523, U.S. Pat. No. 4,955,745, U.S. Pat. No. 4,927,282, U.S. Pat. No. 5,826,741, U.S. Pat. No. 5,810,497, U.S. Pat. No. 5,035,525 and U.S. Pat. No. 4,640,637, the entire disclosures of which are hereby incorporated by reference.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A nail polish applicator comprising:

a container having at least first and second open chambers, the first chamber containing a first nail polish and the second chamber containing a different second nail polish;

at least one cap adapted to seal and cover the openings of the first and second chambers; and at least first and second applicators, the first applicator being adapted to apply the first nail polish to a nail and the second applicator being adapted to simultaneously apply the second nail polish to the same nail.

2. A nail polish applicator according to claim 1, wherein the container has two or more open chambers, the chambers together having at least two different nail polishes.

3. A nail polish applicator according to claim 1, wherein the first and second applicators each comprises an extended member and application means.

4. A nail polish applicator according to claim 3, wherein the application means are identical.

5. A nail polish applicator according to claim 3, wherein the application means are different.

6. A nail polish applicator according to claim 3, wherein the application means independently comprises foam, sponge, pad, rubber, plastic, cotton, mohair, taffeta, urethane, neoprene, nylon fleece, terry cloth, tricot, felt, a bristle brush wherein the bristles extend along a longitudinal axis defined by the extended member or a smooth, porous, adsorbent, absorbent or fibrous material used to apply liquids to surfaces.

7. A nail polish applicator according to claim 1, wherein the at least one cap and the at least first and second applicators are at least one of:

integral in construction, removably engaged, fixedly engaged, slidably engaged and rotatably engaged.

8. A nail polish applicator according to claims 7 wherein the at least one cap and the at least first and second applicators are integral, the at least one cap snaps onto the container and the at least one cap further comprise a handle.

9. A nail polish applicator according to claim 8 further comprising an overcap which engages the container, wherein at least one of the overcap and the at least one cap sealing engages the container.

10. A nail polish applicator according to claim 1, wherein the at least one cap snaps onto or threads onto the container.

11. A nail polish applicator according to claim 1, wherein the container comprises two or more individual containers that are held side-by-side by way of an attachment means.

12. A nail polish applicator according to claim 1, wherein the cap has a handle.

13. A method of simultaneously applying two different nail polishes to a nail comprising the steps of:

(a) providing an applicator comprising at least first applicator means having thereon a first nail polish and second applicator means having thereon a different second nail polish, wherein the first and second applicator means are disposed side by side; and (b) simultaneously applying the first and second nail polishes to the nail.

14. A method according to claim 13, wherein the method further comprises one or more of the steps of:

(c) providing at least first and second open chambers, the first chamber containing the first nail polish and the second chamber containing the second nail polish; and (d) providing closing and retaining means for sealing the open first and second chambers and retaining the first and second applicator means, respectively, therein.

15. A method according to claim 13 further comprising the step of applying a base nail polish to a nail prior to step (b).

16. A method according to claim 13 further comprising the step of:

(c) providing a container comprising at least a first open chamber containing a first nail polish and a second open chamber containing a second nail polish, said chambers being adapted to receive an applicator, wherein said step is conducted before step(b).

17. A method according to claim 13 further comprising the step of:

(c) providing a container comprising two or more individual containers that are held side by side by attachment means, wherein each of the individual containers has a different nail polish and wherein said step is conducted before step (b).

18. A nail polish applicator comprising:

a multi-chambered container having two or more side-by-side openings and each chamber comprising a different nail enamel reservoir; and a handle comprising two spaced apart, resiliently connected elements, each element connected to an applicator brush adapted to be placed in the openings to receive portions of respective nail polish reservoir on the brushes, the handle and brushes having means to sealingly engage the openings of the multi-chambered container to seal the openings, wherein when the brushes are withdrawn from the openings, the brushes can be brought closer together by applying pressure to the elements, and the bristles on the brushes extend longitudinally in the direction of insertion of the brushes into the multi-chambered container.

19. A nail polish applicator comprising a container having two or more tubular cells adapted to house two or more portions of nail polish in mutual isolation, wherein the portions comprise different types of nail polish; and two brushes of a size and shape adapted to be repeatedly inserted into and removed from the cells with each of the brushes having a rod formed with bristles along a first end and a handle formed on the opposite end and with the bristles of the two brushes extending longitudinally along an axis defined by the rod.

20. A nail polish applicator according to claim 1, wherein the at least first and second applicators form a first applicator assembly having a handle and the at least one cap is an overcap which-engages the container and covers the first applicator assembly.

* * * * *